US007298285B2

(12) United States Patent
Moriarty

(10) Patent No.: US 7,298,285 B2
(45) Date of Patent: Nov. 20, 2007

(54) ROTARY DOWNLINK SYSTEM

(75) Inventor: Keith Alan Moriarty, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 393 days.

(21) Appl. No.: 10/799,817

(22) Filed: Mar. 12, 2004

(65) Prior Publication Data

US 2005/0209782 A1 Sep. 22, 2005

(51) Int. Cl.
*G01V 3/00* (2006.01)

(52) U.S. Cl. ..... 340/853.3; 340/854.4; 324/166; 166/250.01

(58) Field of Classification Search ..... 340/854.3, 340/853.3; 324/166; 418/11; 166/250.01; 175/57

See application file for complete search history.

(56) References Cited

U.S. PATENT DOCUMENTS

| | | | | |
|---|---|---|---|---|
| 1,892,217 | A | 12/1932 | Moineau | 74/458 |
| 4,647,853 | A | 3/1987 | Cobern | 324/166 |
| 4,763,258 | A | 8/1988 | Engelder | 340/853.3 |
| 5,518,379 | A * | 5/1996 | Harris et al. | 418/11 |
| 5,785,509 | A * | 7/1998 | Harris et al. | 418/11 |
| 6,267,185 | B1 | 7/2001 | Mougel et al. | 175/57 |
| 6,419,014 | B1 * | 7/2002 | Meek et al. | 166/255.2 |
| 6,714,138 | B1 * | 3/2004 | Turner et al. | 340/854.3 |
| 2003/0016164 | A1 | 1/2003 | Finke et al. | |

* cited by examiner

*Primary Examiner*—Albert K. Wong
(74) *Attorney, Agent, or Firm*—Matthias Abrel; Dale V. Gaudier; Brigitte L. Echols

(57) ABSTRACT

A method for downlink communication with a downhole tool having a mud-powered downhole motor that includes receiving a sensor signal related to a rotational speed of a rotor in the mud-powered downhole motor, and interpreting the sensor signal to derive a downlink signal.

18 Claims, 4 Drawing Sheets

ROTARY DOWNLINK SYSTEM

BACKGROUND OF INVENTION

Wells are generally drilled into the ground to recover natural deposits of hydrocarbons and other desirable materials trapped in geological formations in the Earth's crust. A well is typically drilled using a drill bit attached to the lower end of a drill string. The well is drilled so that it penetrates the subsurface formations containing the trapped materials and the materials can be recovered.

At the bottom end of the drill string is a "bottom hole assembly" ("BHA"). The BHA includes the drill bit along with sensors, control mechanisms, and any required circuitry. A typical BHA includes sensors that measure various properties of the formation and of the fluids that are contained in the formation. A BHA may also include sensors that measure the BHA's orientation and position.

Drilling operations are controlled by an operator at the surface. The drill string is rotated at a desired rate by a rotary table, or top drive, at the surface, and the operator controls the weight-on-bit and other operating parameters of the drilling process.

Another aspect of drilling and well control relates to the drilling fluid, called "mud." The mud is a fluid that is pumped from the surface to the drill bit by way of the drill string. The mud serves to cool and lubricate the drill bit, and it carries the drill cuttings back to the surface. The density of the mud is carefully controlled to maintain the hydrostatic pressure in the borehole at desired levels.

Some drilling systems use a "mud motor" to rotate the drill bit. A mud motor is a device in the BHA that converts some of the fluid power in the downward flow of mud into rotational motion. With a mud motor, the drill bit may be rotated without having to rotate the entire drill string from the surface. Commonly used mud motors include turbine motors and positive displacement motors.

In order for the operator to be able to control the direction of the drill bit or to control downhole sensors or instruments, communication between the operator at the surface and the BHA are necessary. A "downlink" is a communication from the surface to the BHA. Likewise, an "uplink" is a communication from the BHA to the surface. Based on the data collected by the sensors in the BHA, an operator may desire to send a signal via downlink to the BHA. A common downlink signal is an instruction for the BHA to change the direction of drilling or to perform a test or collect data. Downlink signals are also used to activate and deactivate various MWD sensors while the borehole is being drilled. During borehole workover operations, various types of downhole or bottom equipment are activated by downlink signals from the surface.

There are various prior art downlink methods. One class of downlink methods is called "mud pulse telemetry." Mud pulse telemetry uses pulses in the mud flow rate or pressure to communicate with the BHA.

One method of mud pulse telemetry uses the mud pumps at the surface to control the mud flow rate to the BHA. The flow rate is detected and interpreted by the downlink system. This may be accomplished using a mud turbine generator in the BHA. The amount of power generated by the turbine is related to the mud flow rate. Alternatively, the mud flow rate can be determined by monitoring the rates of rotation of a positive displacement mud motor ("PDM") or a drilling mud turbine (called a "turbodrill"). For example, U.S. Pat. No. 4,647,853 issued to Cobern discloses a system for detecting the rate of rotation of a downhole turbine using a triaxial magnetometer, which is commonly used to define the location and orientation of the downhole drilling assembly. A powerful permanent magnet is mounted on the uphole end of the turbine drive shaft, with the magnetic moment of the magnet perpendicular to the axis of the turbine shaft. As the turbine shaft rotates, this turbine mounted magnet superimposes a rotating magnet field on the earth's magnetic field in the vicinity of the turbine. This superimposed rotating field constitutes a mud motor tachometer signal, which is sensed and separated from the response of the system's existing magnetometer. The signal defines the rotation rate of the mud motor turbine, and hence the mud flow rate.

Another method of mud pulse telemetry uses pressure pulses for communicating with the BHA. A pressure pulse is transmitted from the surface, and pressure sensors in the BHA detect and interpret the pressure pulses generated at the surface.

Other methods for downlink communication include changing drill string rotation rates. For example, U.S. Pat. No. 4,763,258 issued to Engelder discloses methods and apparatus for telemetering while drilling by changing drill string rotation angle or drill string rotation rate or rotation "speed". The magnitude of an incremental rotation of the drill string is related to a downhole function, such as the activation of a specific downhole sensor. The incremental rotation is sensed by a downhole inclinometer and magnetometer, which are normally carried by a deviated hole downhole drilling system to define the orientation and location of the downhole equipment.

Similarly, U.S. Pat. No. 6,267,185 issued to Mougel, et al., discloses downlink methods by rotating drill string by discrete angles. The sequence of discrete angular rotations is sensed downhole by a gyroscope and decoded as a command in a microprocessor. An alternative method involves rotating the drill string by different angular rates, which are likewise sensed by the gyroscope and decoded in the microprocessor. The microprocessor then transmits the decoded command to the controlled equipment.

While these prior art methods are capable of providing downlink communications, there is still a need for more reliable downlink systems that are capable of providing improved quality and speed of downlink communications.

SUMMARY OF INVENTION

In some embodiments, the invention relates a method for downlink communication with a downhole tool having a mud-powered downhole motor. The method may include receiving a sensor signal related to a rotational speed of a rotor in the mud-powered downhole motor, and interpreting the sensor signal to derive a downlink signal. Receiving the sensor signal may also include determining a rotational speed of at least part of a bottom hole assembly.

In some other embodiments, the invention relates to a downlink communication system for a downhole tool. The system may include a mud-powered downhole motor disposed in the downhole tool, at least one sensor disposed in the downhole tool for making measurements related to a rotational speed of a rotor in the mud-powered downhole motor, and an electronics package operatively coupled to the at least one sensor and configured to interpret a downlink signal based on an output of the at least one sensor. In at least one embodiment, the system includes a rotary steerable system.

Other aspects and advantages of the invention will be apparent from the following description and the appended claims.

DETAILED DESCRIPTION

In some embodiments, the invention relates to a method for receiving a downlink signal in a drilling system. In other embodiments, the invention relates to a downlink communication system for receiving a downlink signal. Certain exemplary embodiments of the invention will now be described with reference to the attached figures.

Figure 1:
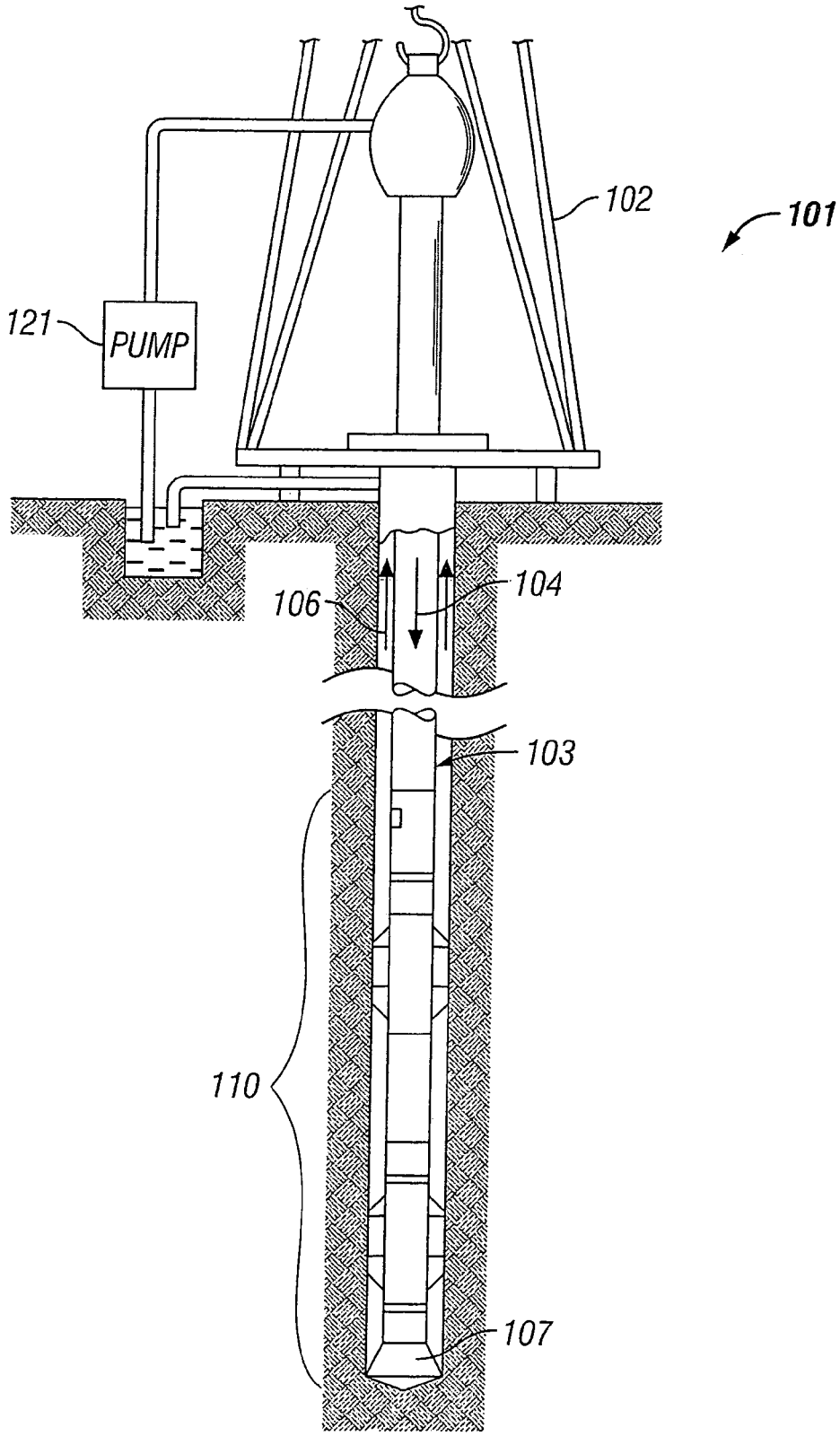
FIG. 1 shows a cross section of a drilling system in accordance with one embodiment of the invention.

FIG. 1 shows a typical drilling system 101. A drilling rig 102 at the surface is used to rotate a drill bit 107 using a drill string 103. Using a mud pump 121, drilling fluid, called "mud," is pumped to the drill bit 107 through the drill string 103. The downward flow of mud is represented in FIG. 1 by downward arrow 104. The mud lubricates and cools the drill bit 107 and carries the drill cuttings back to the surface as it flows upwardly through the annulus. The return flow of mud is represented by the upward arrow 106.

The drilling system 101 includes a "bottom-hole assembly" 110 ("BHA") at the lower end of the drill string 103. The BHA 110 includes the drill bit 107 and any sensors, testers, tools, or other equipment used in the drilling process. Such equipment may include formation evaluation tools, measurement and telemetry tools, directional drilling tools, and any associated control circuitry.

Figure 2:
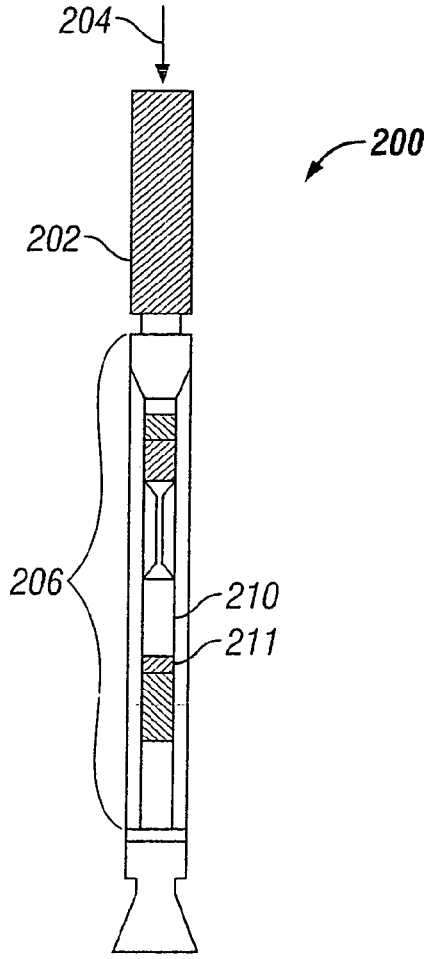
FIG. 2 shows a cross section of a drill collar in accordance with one embodiment of the invention.

FIG. 2 shows a drill collar 200 for receiving a downlink signal in accordance with one embodiment of the invention. The drill collar 200 includes a mud-powered downhole motor 202 ("mud motor"). In this disclosure, the term "mud motor" is used generically to describe a mud-powered downhole motor, such as a positive displacements mud motor ("PDM"), a turbine drilling motor ("turbodrill"), and any other mud-powered downhole motors known in the art.

In accordance with some embodiments of the invention, the mud motor 202 converts fluid power in the downward mud flow (represented at arrow 204) into rotary motion. The rotary motion is transmitted to the portions of the drill collar 200 below the mud motor 202, as well as any additional drill collars (not shown) connected below mud motor 202. Thus, everything connected below the mud motor 202 will rotate with respect to the mud motor 202 and the portions of the drill string above the mud motor 202 (not shown).

Figure 3:
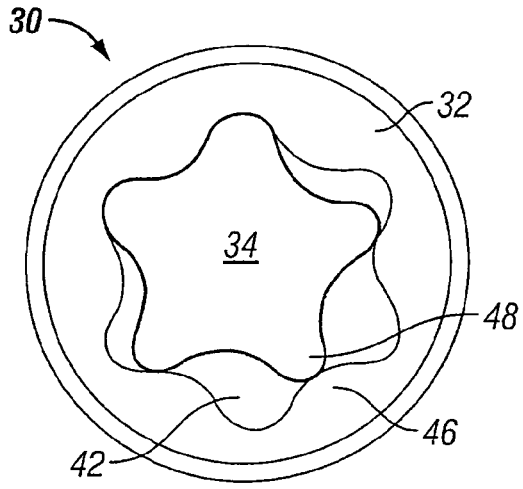
FIG. 3 shows a cross section of a positive displacement motor.

In some embodiments, the mud motor 202 comprises a PDM. PDMs are known in the art and are commonly used to drill wells in earth formations. PDM's operate according to a reverse mechanical application of the well known Moineau principle, wherein pressurized fluid is forced through a series of channels formed between a rotor and a stator. See, e.g., U.S. Pat. No. 1,892,217, issued to Moineau. FIG. 3 shows a cross section of a conventional PDM 30, which comprises a stator 32 and a rotor 34. The stator 32 and the rotor 34 each comprises a plurality of lobes, 46 and 48, respectively, with the stator 32 having one lobe more than the rotor 34. This leaves a channel 42 that forms a fluid passage. The lobes on the stator 32 and rotor 34 are generally helical in shape and typically extend the entire length of the stator 32 and rotor 34. Therefore, the channel 42 is also helical in shape along the length of the PDM 30. The passage of the pressurized fluid through the helical channel 42 causes the rotor 34 to rotate within the stator 32. The rotor 34 may be connected to a BHA, an RSS unit, or a drill bit as shown in FIG. 2. A PDM is one type of mud motor that may be used with the invention. Other mud motors may be used without departing from the scope of the invention.

It is noted that FIG. 2 shows an RSS 206 is connected below the mud motor 202, but other types of equipment (e.g., measurement equipment or drill bit) may be connected below the mud motor 202. In addition, a drill collar may include a bent housing or other directional drilling device. In some embodiments, a drill collar may include only a mud motor and sensors for the purpose of receiving a downlink system. The following description uses an RSS 266 for illustration. However, the invention is not intended to be limited by the type of equipment included with a drill collar.

The rotational speed of the RSS 206, or any device connected below the mud motor 202, may be controlled by changing the mud flow rate through the mud motor 202. By holding the drill string (e.g., 103 in FIG. 1) stationary (or at a constant rotation rate) and carefully controlling the mud flow rate, the rotational speed of the RSS 206 relative to the Earth or relative to the drill string can be controlled. In a preferred embodiment, the drill string, including the BHA, is lifted off the bottom of the hole. This will reduce the friction acting against rotation and enable better control of the rotational speed of the RSS 206.

The RSS 206 includes a sensor package 210, often called a "direction and inclination sensor assembly" ("D & I package"), that is able to determine the direction and inclination of the drill bit. The sensor package 210 may include magnetic, inertial, and gravitational sensors, which may include magnetometers, gyroscopes, and accelerometers (not shown), among other sensors. These sensors generate signals based on the position and the motion of the RSS 206. The rotational speed of the RSS 206 may be determined from the output of the sensors in the sensor package 210. Such methods for determining the rotational speed of a downhole section or component is known in the art. See e.g., U.S. Pat. No. 4,647,853, noted above.

In some embodiments, the sensor package 210 is operatively connected to an electronics package 211. The electronics package 211 helps to determine the rotational speed of the RSS 206 based on the output of the sensor package 210. In addition, the electronics package 211 functions to decipher the downlink signals based on the determined rotational speeds and then to control the downhole equipment (e.g., to change the drill bit direction, to take MWD measurements, to change the configuration of components in the BHA, etc.) based on the deciphered commands.

Figure 4:
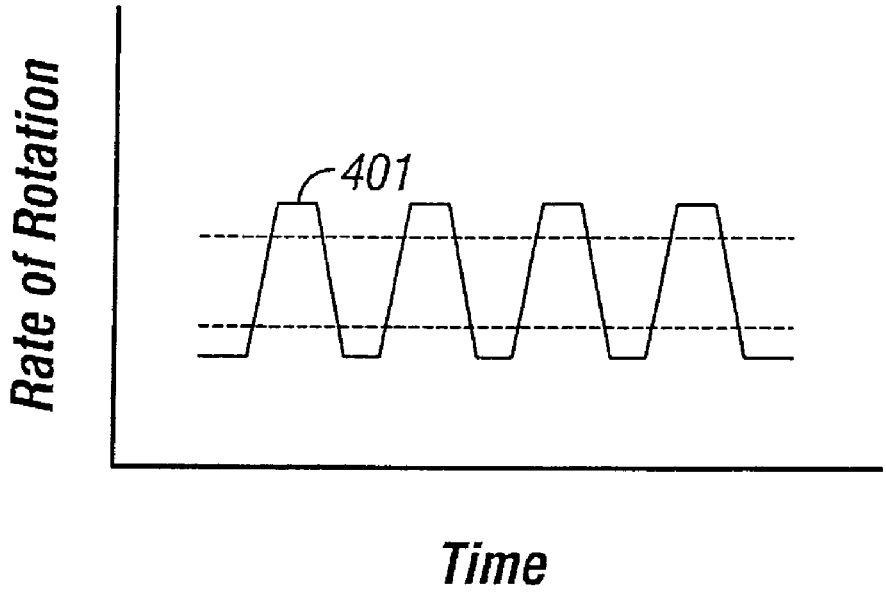
FIG. 4 shows a graph of a downlink signal in accordance with one embodiment of the invention.

The rotational speed of the RSS 206 may be controlled by the mud flow rate to provide a downlink signal according to various schemes. For example, FIG. 4 shows a scheme in which two rotational speeds (high and low) are used to encode a downlink signal. In FIG. 4, a graph 401 of the rotational speed of an RSS with respect to time is shown. As the mud flow rate is increased, the rotational speed of the RSS is increased to the high rotational rate. Conversely, when the mud flow rate is decreased, the rotational speed of the RSS is decreased to the low rotational rate. The changes in the rotational speed of the BHA or RSS, as shown in FIG. 4, have frequencies and amplitudes that represent a downlink signal.

Based on the frequencies and amplitudes, a downlink signal, for example, may be encoded by: (1) the number of high-low switches in a train, which may be followed by a pause period of no flow or low flow rate; (2) the number of high-low switches within a specific duration; (3) the temporal spacings between the high-low switches (i.e., frequency modulation); (4) the magnitudes of the high rotational rates with respect to the low rotational rates (i.e., amplitude modulation); and (5) the rates of changes from the low to high rotational rates (or from high to low rotational rates) (i.e., ramping rates).

Different down link signals may represent different instructions to the BHA or RSS. For example, one particular signal may be an instruction for the BHA to take a sample of the formation fluid. Another particular signal may represent an instruction to drill in a particular direction. The form of the signal and the instruction sent are not intended to limit the invention. FIG. 4 shows an example using a high rotation rate and a low rotational rate to encode the downlink signal. One of ordinary skill in the art would appreciate that this is only for illustration and embodiments of the invention may use any combination of rotational rates (i.e., different amplitudes) and temporal patterns.

Figure 5:
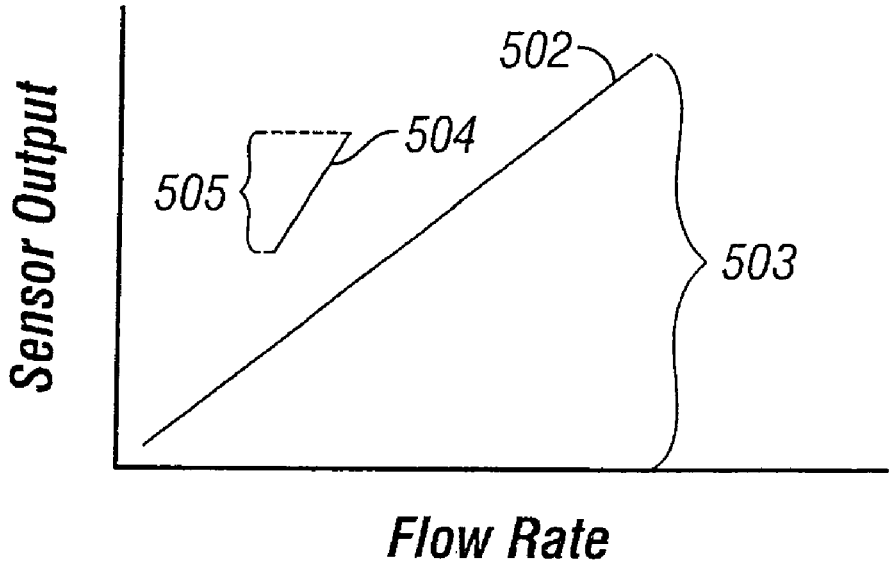
FIG. 5 shows a graph of sensor output based on mud flow rate for prior art devices and a downlink device in accordance with certain embodiments of the invention.

As noted above, some embodiments of the invention use a mud motor, such as a PDM or a turbodrill. FIG. 5 shows one of the possible advantages that a downlink receiving system in accordance with the invention may have over the prior art. The sensor output, shown on the Y-axis, varies based on the rotational speed of the RSS 206, which is, in turn, based on the mud flow rate, shown on the X-axis. The response curve 502 for sensor output of system using a PDM has a much larger dynamic range 503 than the range 505 for the response curve 504 of previous systems using turbine electrical power generators. This is because the turbine blade angles determine how fast the turbine rotates at a specific mud flow rate. Once a blade angle is selected, the turbine electrical power generator can be operated only in a limited range, as shown in 505. In contrast, a mud motor can respond to the flow rate in a much wider range. Thus, a downlink system based on the sensor output related to rotation generated by a mud motor is more versatile and controllable.

Figure 6:
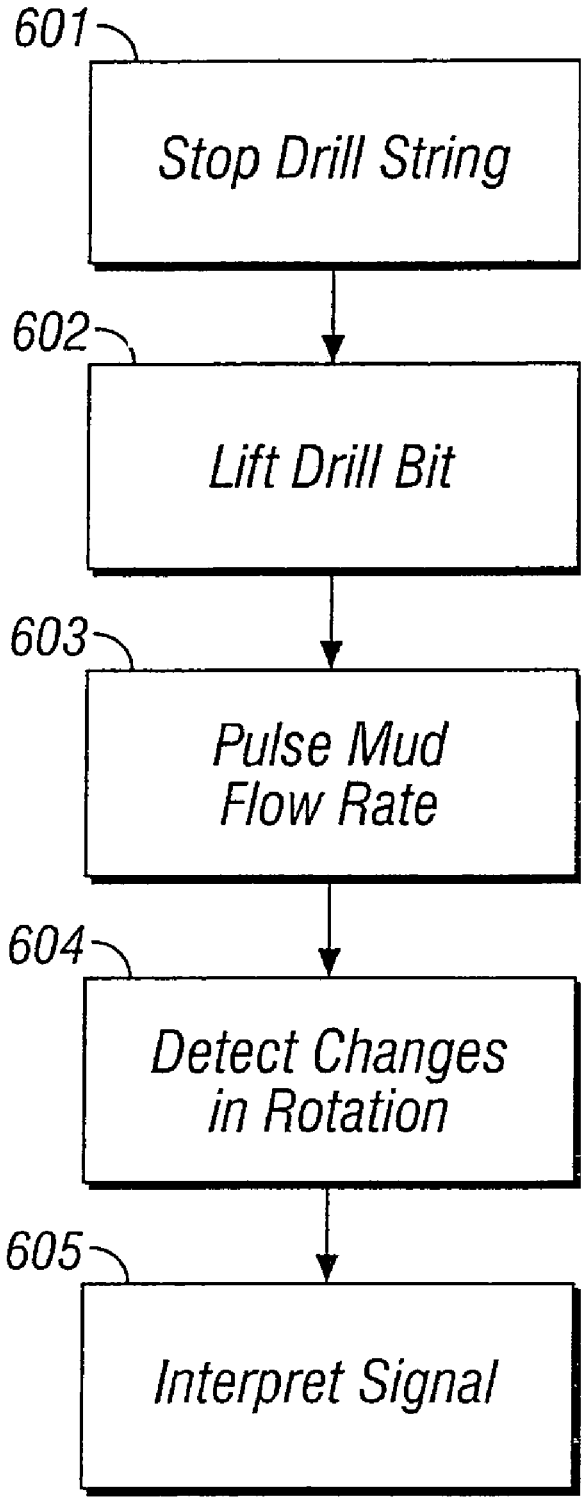
FIG. 6 shows one embodiment of a method in accordance with the invention.

FIG. 6 shows one embodiment of a method 600 for receiving a downlink signal in accordance with the invention. The method may include first stopping drilling operations (step 601). However, this step is optional because a downlink system according to embodiments of the invention can determine the rotational speeds of the rotor relative to the stator in a mud motor, and it is unnecessary to completely stop the drill string rotation.

In some embodiments, the method next includes lifting the drill bit off the bottom of the borehole (step 602). This will enable the BHA to rotate without having to overcome the resistance between the drill bit and the bottom of the borehole, and, therefore, permits a better control of the rotational speed.

The method next includes regulating the mud flow rate (step 603). In some embodiments, this is accomplished by changing the speed of the mud pumps that are located at the surface. A downlink signal may be encoded in the frequency, amplitude, or rates of the changes in mud flow.

The method next includes detecting changes in the rotational speed of the BHA below a mud motor (step 604). In some embodiments, the rotational speed is generated by a mud motor, such as a PDM or a turbodrill. In some embodiments, detecting the rotational speed is accomplished using sensors, such as a D&I package, that are disposed in the BHA or any other sensors known in the art. The mud motor generates rotation of at least a portion of the BHA. That rotational speed is related to the mud flow rate that is being regulated from the surface. The changes in rotational speed represent the downlink signal.

The changes in the rotational speed of the BHA may be interpreted by an electronics package in the BHA (step 605). The changes in the rotational speed may be interpreted as a downlink signal to the BHA. Such a signal may include instructions to perform a test, take a measurement or sample, or drill in a particular direction.

In some embodiments, a downlink signal may be interpreted without having to determine the rotational speed of the BHA. The sensors in the BHA may generate an electronic signal that is based on the rotational speed of the BHA, and the downlink signal may be interpreted directly from the sensor signal. In these embodiments, the downlink signal is interpreted without having to explicitly determine or compute the rotational speed of the BHA.

Advantageously, a downlink method in accordance with the invention enable the sending and receiving of mud pulse downlink signals with a large dynamic range. This, in turn, enables a higher frequency and a faster rate of communication. It also enables more versatile or sophisticated control of the downhole equipment, which may be an LWD/MWD instrument, a directional drilling tool, or other downhole tool known in the art.

Advantageously, a downlink system of method in accordance with the invention will not be affected by stick-slip or the unsteady rotation of the drill string over its length. The flow of mud passes through the inside of the drill string, where it is not affected by the borehole wall or various other downhole anomalies that may affect the rotation of the drill string.

Additionally, embodiments of a downlink system or method in accordance with the invention do not require special equipment to generate complex flow and pressure control. The large dynamic range that is enabled by the invention also enables control using typical mud pumps and control mechanisms. The invention does not, however, exclude the use of such equipment.

Advantageously, a downlink system or method in accordance with the invention is reliable. Because of the great expense associated with drilling, downlink instructions are typically verified so that costly miscommunications may be avoided. Downlink methods and systems in accordance with the invention may not only reduce the time to send and receive signals, they may also increase the chance that a downlink signal is properly interpreted on the first attempt to send a signal.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for downlink communication with a downhole tool having a mud-powered motor, comprising:

receiving a sensor signal indicative of a rotational speed of a rotor in the mud-powered downhole motor; and interpreting the sensor signal at the downhole tool to derive a downlink signal.

2. The method of claim 1, wherein the receiving the sensor signal comprises determining a rotational speed of at least part of a bottom hole assembly.

3. The method of claim 1, further comprising varying a mud flow rate from a surface.

4. The method of claim 1, further comprising stopping a rotation of a drill string at a surface.

5. The method of claim 1, further comprising lifting a drill bit off a bottom of a borehole.

6. The method of claim 1, further comprising controlling a downhole equipment based on the derived downlink signal.

7. The method of claim 1, wherein the interpreting the sensor signal comprises computing at least one selected from a magnitude of the sensor signal, a rate of change of the sensor signal, and a temporal pattern of the sensor signal.

8. The method of claim 1, wherein the mud-powered downhole motor comprises a positive displacement mud motor.

9. The method of claim 1, wherein the mud-powered downhole motor comprises a drilling mud turbine.

10. A downlink communications system for a downhole tool, comprising:

a mud-powered downhole drilling motor disposed in the downhole tool;

at least one sensor disposed in the downhole tool for making measurements indicative of a rotational speed of a rotor in the mud-powered downhole motor; and an electronics package operatively coupled to the at least one sensor and configured to interpret a downlink signal based on an output of the at least one sensor.

11. The downlink system of claim 10, wherein the downhole tool comprises a bottom hole assembly connected below the mud-powered downhole motor, and wherein the at least one sensor and the electronics package are disposed in the bottom hole assembly.

12. The downlink system of claim 11, further comprising a rotary steerable system disposed in the bottom hole assembly.

13. The downlink system of claim 12, wherein the at least one sensor is disposed in the rotary steerable system.

14. The downlink system of claim 10, wherein the at least one sensor comprises a magnetometer.

15. The downlink system of claim 10, wherein the at least one sensor comprises an accelerometer.

16. The downlink system of claim 10, wherein the at least one sensor comprises a gyroscope.

17. The method of claim 10, wherein the mud-powered downhole motor comprises a positive displacement mud motor.

18. The method of claim 10, wherein the mud-powered downhole motor comprises a drilling mud turbine.

* * * * *